US007064266B2

(12) United States Patent
Wada

(10) Patent No.: US 7,064,266 B2
(45) Date of Patent: Jun. 20, 2006

(54) SHIELDED CONNECTOR

(75) Inventor: Yoshimasa Wada, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/153,199

(22) Filed: Jun. 15, 2005

(65) Prior Publication Data

US 2005/0282438 A1 Dec. 22, 2005

(30) Foreign Application Priority Data

Jun. 17, 2004 (JP) ..... 2004-179861

(51) Int. Cl.
*H01R 13/648* (2006.01)

(52) U.S. Cl. ..... 174/35 C; 439/607; 439/610

(58) Field of Classification Search ..... 174/35 C; 439/607, 609, 610
See application file for complete search history.

(56) References Cited

U.S. PATENT DOCUMENTS 4,634,208 A * 1/1987 Hall et al. ..... 439/610
4,650,270 A * 3/1987 Tajima et al. ..... 439/607
4,674,807 A * 6/1987 Boteler et al. ..... 439/607
4,854,895 A * 8/1989 Komatsu ..... 439/610
4,887,971 A * 12/1989 Reuss et al. ..... 439/610
4,941,850 A * 7/1990 Ankers et al. ..... 439/610
4,985,002 A * 1/1991 Maisch et al. ..... 439/607
5,319,156 A * 6/1994 Fonteneau et al. ..... 174/35 R
5,409,400 A * 4/1995 Davis ..... 439/610
6,113,429 A * 9/2000 Weigel et al. ..... 439/610
6,157,548 A * 12/2000 Collins et al. ..... 174/35 R
6,168,466 B1 * 1/2001 Chiou ..... 439/607

FOREIGN PATENT DOCUMENTS

JP 8-96919 12/1996

* cited by examiner

*Primary Examiner*—Dean A. Reichard
*Assistant Examiner*—Adolfo Nino
(74) *Attorney, Agent, or Firm*—Gerald E. Hespos; Anthony J. Casella

(57) ABSTRACT

A shielded connector (A) is used with a conductive path (B) that has wires (10) extending beyond an end of a conductive shield (11). The shielded connector (A) has a housing (20) for accommodating terminal fittings (40) connected with ends of the wires (10). The wires (10) are surrounded by a conductive shield (11). A conductive tube (50) connects an end of the shield (11) and the shielding shell (30) and surrounds the wires (10). An insulating wire cover (80) is disposed between the conductive tube (50) and the wires (10). The insulating coating of the wires (10) could be peeled off to expose a conductor inside. However, the wire cover (80) prevents electrical contact of such a conductor and the conductive tube (50).

12 Claims, 8 Drawing Sheets

SHIELDED CONNECTOR

BACKGROUND OF THE INVENTION

1. Field of the Invention

The present invention relates to a shielded connector.

2. Description of the Related Art

Japanese Unexamined Patent Publication No. H08-96919 discloses an end processing for a shielded conductor path. The shielded conductor path has wires surrounded by a tubular shield made of a braided wire. Terminal fittings are connected with ends of the respective wires and are accommodated in a housing. A cable is formed by twisting an end of the shield and branched off from the conductor path. A grounding terminal is secured to the branched cable and is connected with a grounding member such as a body.

The above-described construction requires a step of connecting the grounding terminal in addition to a step of connecting a housing having terminal fittings accommodated therein with a mating housing. This increases the number of operation steps and is inefficient.

A proposal has been made to provide the housing with a shielding shell and to connect an end of the shield with the shielding shell. Thus, the shielding shell can be connected with the grounding member of the mating housing when the housing is connected with the mating housing. As a result, there is no separate step of connecting the shield with the grounding member.

A metal tube connects the shielding shell and the shielding member in the above construction. However, the wires may abrade against the inner wall of the tube due to vibration, which in turn may peel off the insulation coatings of the wires to expose conductors inside. Then, there is a danger of shorting the conductors of the wires with the connecting tube.

The invention was developed in view of the above problem and an object thereof is to maintain electrical reliability by avoiding the shorting of conductors of wires.

SUMMARY OF THE INVENTION

The invention is a shielded connector connectable with a shielded conductor path. The shielded conductor path may have wires surrounded by a tubular shield made of a braided wire. The shielded connector has a housing for accommodating terminal fittings connected with ends of the wires. A metal shielding shell is mounted in the housing or is molded with the housing as an insert. A conductive tube connects the shielding shell and the shield and surrounds the wires. Insulation is disposed between the conductive tube and the wires to define a specified space therebetween.

The insulation could be peeled off the wire to expose a conductor inside, for example, due to vibration. However, the insulation prevents contact of the conductor with the conductive tube. As a result, the wires are not shorted with the conductive tube and electrical reliability is maintained.

The insulation preferably is a wire cover made of a synthetic resin and configured to fit in the conductive tube. The wire cover may include an engaging portion that resiliently engages a portion on the conductive tube.

The wire cover may be fixed to the wires by an insulating tape.

The insulation may be a wire cover made of a rubber and may fit to the inner circumferential surface of the conductive tube. Thus, the wire cover can be mounted in conductive tubes having different diameters within the resiliency range of the wire cover.

The insulation may be an insulating wall integrally extended from the housing. Thus, the number of parts can be reduced.

The wire cover resiliently engages the engageable portion of the conductive tube. The wire can be mounted into the conductive tube through a one-touch operation, thereby simplifying assembly.

DETAILED DESCRIPTION OF THE PREFERRED EMBODIMENTS

Figure 1:
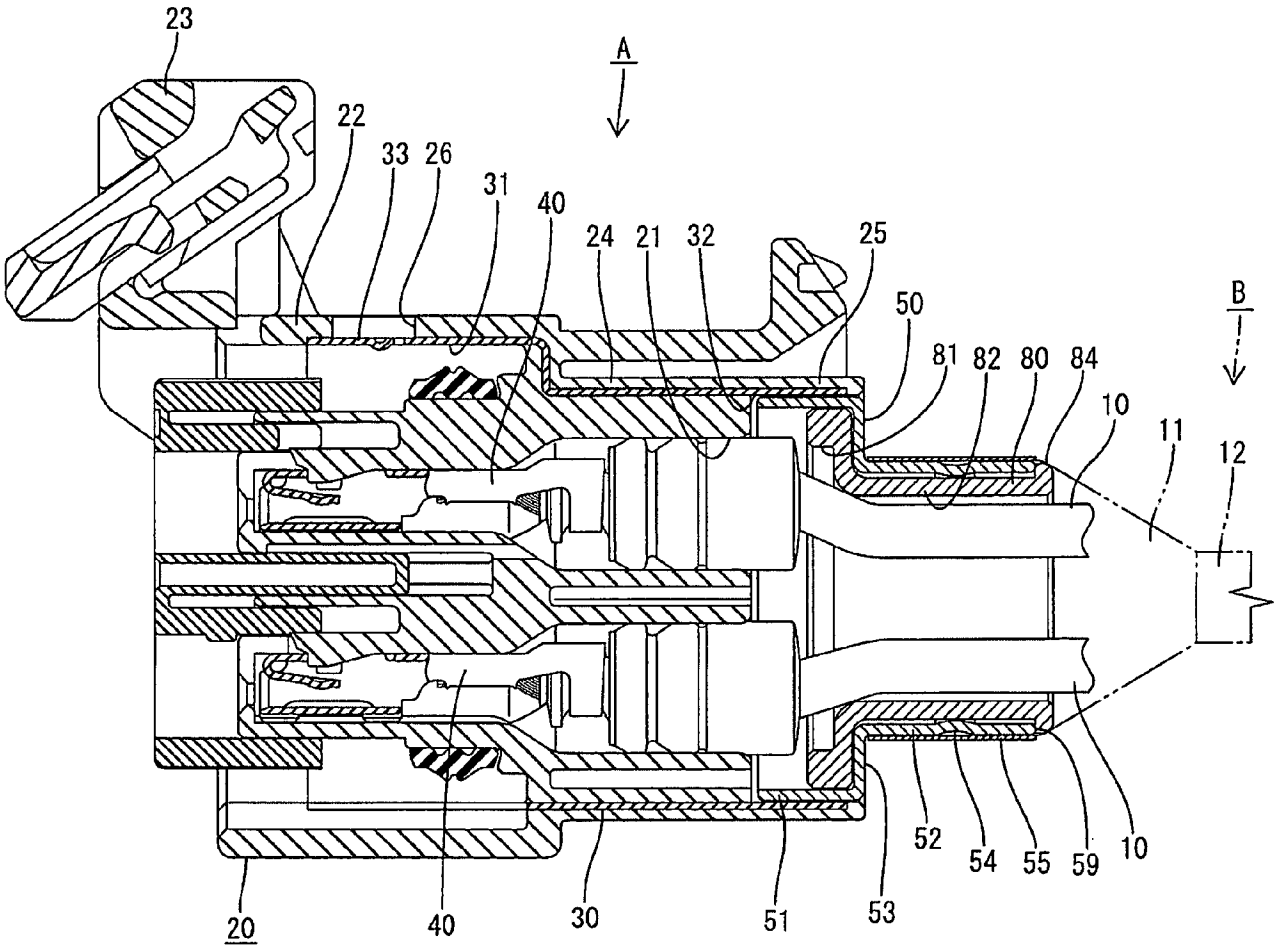
FIG. 1 is a section showing an essential portion of a first embodiment of the invention.
Figure 2:
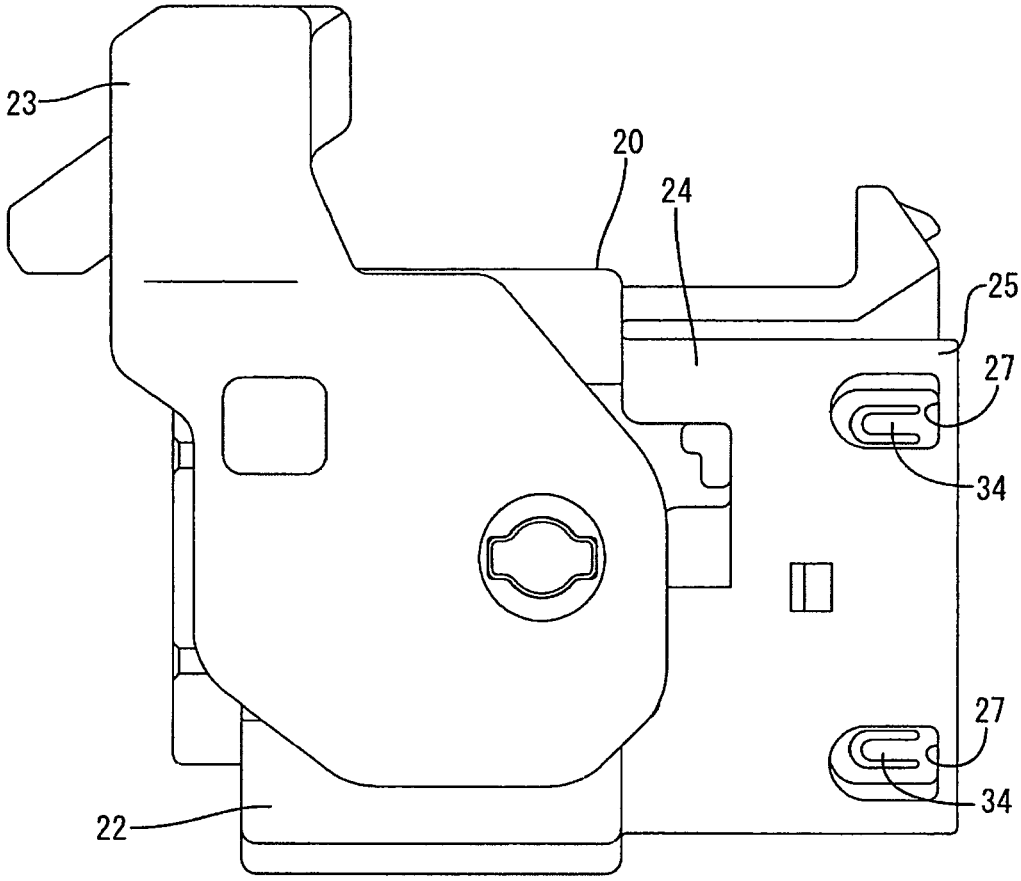
FIG. 2 is a side view of a housing.
Figure 3:
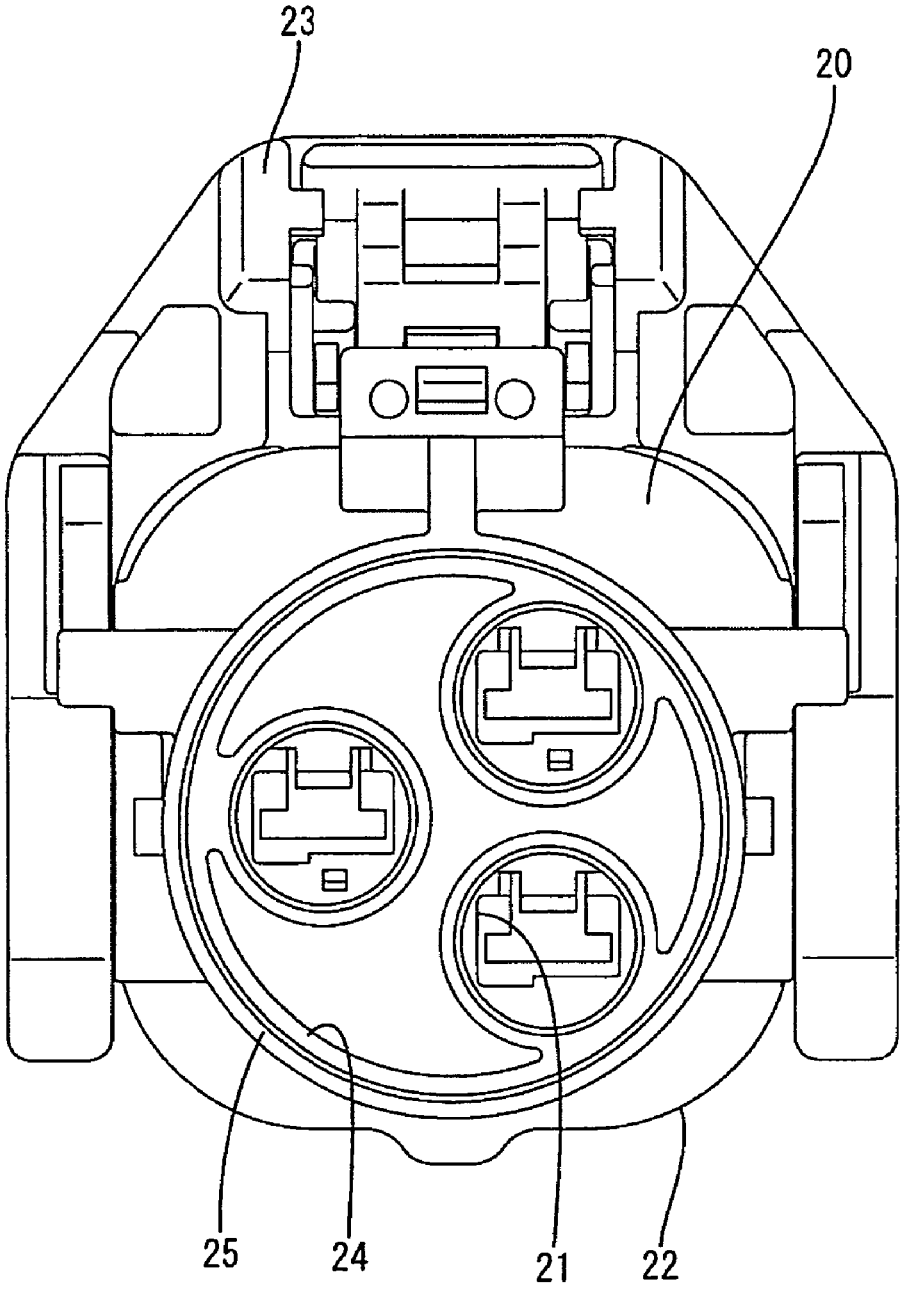
FIG. 3 is a rear view of the housing.

A shielded connector according to a first embodiment of the invention is identified by the letter A in FIGS. 1 to 4 and is connected to a shielded conductor path B. The shielded conductor path B has non-shielded wires 10 surrounded together by a tubular shield 11. Each wire 10 is of known construction and has a conductor surrounded by an insulation coating. The shield 11 is formed by braiding fine metal wires into a mesh, and has sufficient flexibility to be extendible in both longitudinal and radial directions. A sheath 12 is mounted on the outer circumferential surface of the shield 11.

The shielded connector A has a housing 20 made of a synthetic resin and three cavities 21 penetrate the housing 20 in forward and backward directions. A receptacle 22 is formed at substantially a front half of the housing 20. The receptacle 22 is substantially rectangular, but has four rounded corners. A gate-shaped lever 23 is supported rotatably on the outer surfaces of the receptacle 22. The lever 23 is a known connecting/separating means to facilitate connecting the housing 20 with a mating housing (not shown). A fitting portion 24 is formed at a substantially rear half of the housing 20. The fitting portion 24 has a round outer shape and includes a round fitting tube 25 that extends more backward than the rear ends of the cavities 21.

The connector A also has a shielding shell 30 formed integrally with the housing 20 by insert molding. A rectangular tube 31 is formed at substantially the front half of the shielding shell 30 and a round tube 32 is formed at substantially the rear half of the shielding shell 30. The rectangular tube 31 and the round tube 32 are coupled by a step that increases the strength and rigidity of the shielding shell 30 as compared to a shielding shell having a constant cross section. Accordingly, the shielding shell 30 will not be deformed by injection pressure during insert molding. The upper, left and right plates of the rectangular tube 31 are formed with resilient contact pieces 33. The round tube 32 is formed with resilient contact pieces 34 at four equally circumferentially spaced positions (see FIG. 2). The round tube 32 also is formed with locking holes (not shown). The shielding shell 30 is embedded in the housing 20 to extend along the outer surface of the housing 20, and parts of the housing 20 enter the locking holes to position and retain the shielding shell 30 in the housing 20 so as not to come out of the housing 20.

The rectangular tube 31 is exposed along the inner surface of the receptacle 22 and surrounds three terminal fittings 40 in the cavities 21 together. The resilient contact pieces 33 of the rectangular tube 31 can be held resiliently in contact with grounding members (not shown) on the outer peripheral surface of a mating housing. The shielding shell could be assembled into an already molded housing. In this case, the resilient contact pieces are permitted to deform resiliently because of a clearance between the shielding shell and the housing in view of a tolerance and the like. However, the shielding shell 30 and the housing 20 of this embodiment are adhered to each other by insert molding. Thus, there is no space between the shielding shell 30 and the housing 20 for permitting the resilient contact pieces 33 to deform. Accordingly, mold-removal holes 26 open in the outer surface of the receptacle 22 to avoid adherence of the material of the receptacle 22 to the resilient contact pieces 33 during the insert molding. Such material might prevent resilient deformation of the resilient contact pieces 33. Therefore, the resilient contact pieces 33 can be deformed resiliently in radial directions.

The round tube 32 is concentric with the fitting portion 24 and surrounds the three terminal fittings 40 in the cavities 21. A rear end of the round tube 32 is exposed along the inner circumferential surface of the fitting tube 25. The resilient contact pieces 34 of the round tube 32 are arranged at this exposed part and resiliently contact the metal tube 50 when the metal tube 50 is fit into the fitting tube 25. The shielding shell could be assembled into an already molded housing. In this case, the resilient contact pieces are permitted to deform resiliently because of a clearance between the shielding shell and the housing in view of a tolerance and the like. However, the shielding shell 30 and the housing 20 of this embodiment are adhered to each other by insert molding. Thus, there is no space between the shielding shell 30 and the housing 20 for permitting the resilient contact pieces 34 to deform. Accordingly, mold-removal holes 27 are open in the outer surface of the fitting tube 25 to avoid the adherence of the material of the fitting tube 25 to the resilient contact pieces 34. Therefore, the resilient contact pieces 34 can be deformed resiliently.

A female terminal fitting 40 is secured to an end of each wire 10. The terminal fittings 40 are inserted into the cavities 21 from behind and are locked by locks 21*a* formed along inner walls of the cavities 21. The wire 10 extends from the rear end of the terminal fitting 40 and is drawn out backward from the housing 20 through the fitting tube 25.

A metal tube 50 connects the shield 11 of the conductor path B and the shielding shell 30. A round large-diameter portion 51 is formed at substantially a front one-third of the metal tube 50. A round small-diameter portion 52 is formed at a substantially rear two-thirds of the metal tube 50 and is concentric with the large-diameter portion 51. The rear end of the large-diameter portion 51 and the front end of the small-diameter portion 52 are connected via a concentric annular step 53. The outer circumferential surface of the small-diameter portion 52 has a circumferential recess 54 at a substantially longitudinal middle position for crimping. The large-diameter portion 51 of the metal tube 50 is connected with the round tube 32 of the shielding shell 30 by being fit into the fitting tube 25 of the housing 20.

Figure 4:
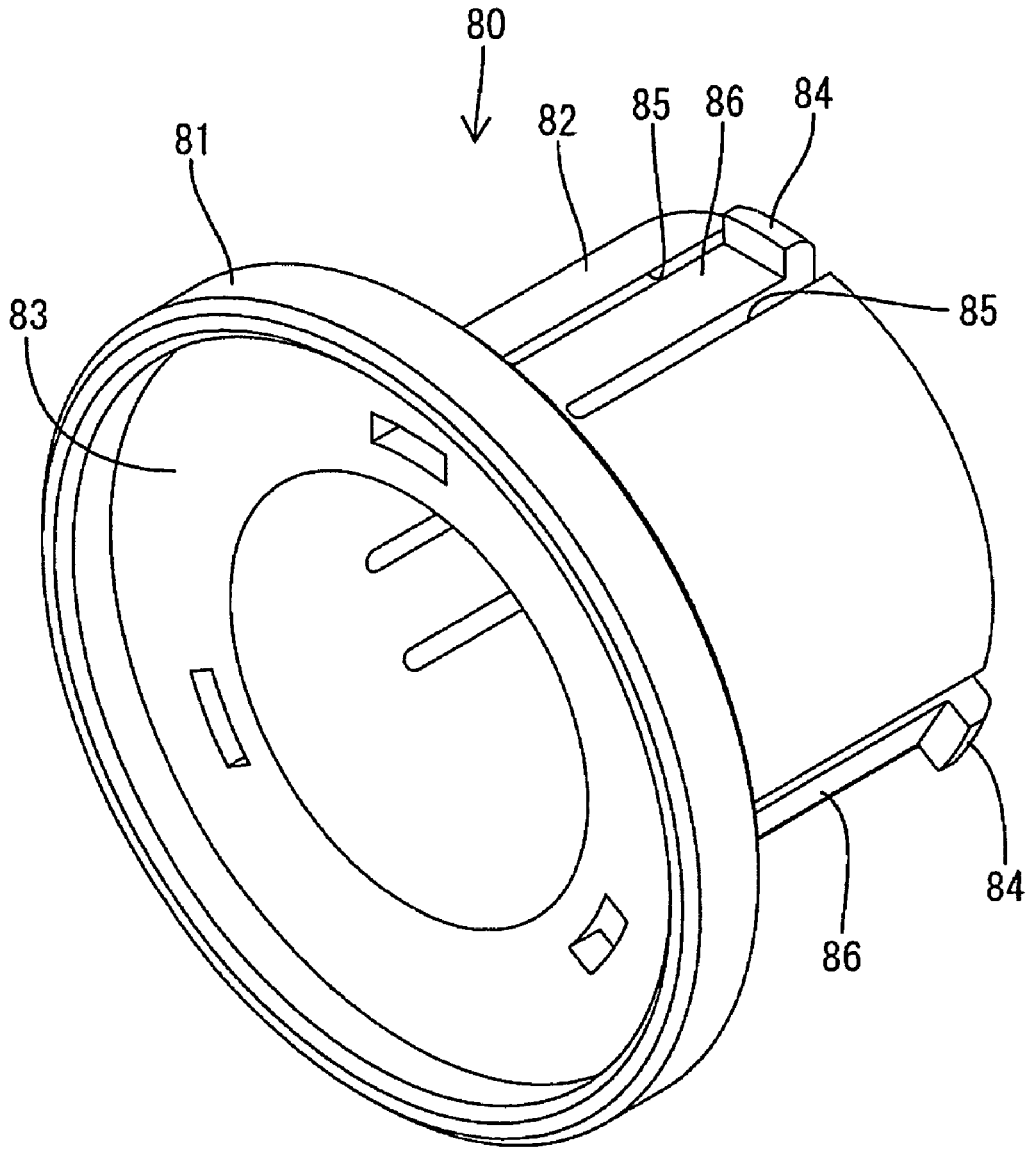
FIG. 4 is a perspective view of a wire cover.

The connector A also has a wire cover 80 made of an insulating synthetic resin and mounted by being fitted into the metal tube 50. As shown in FIG. 4, a round tubular thick portion 81 is formed at substantially the front one-eighth of the wire cover 80, and a round tubular thin portion 82 is formed at substantially the rear seven-eighths of the wire cover 80. The thin portion 82 is concentric with the thick portion 81, but defines a smaller diameter. A step 83 extends concentrically between the rear end of the thick portion 81 and the front end of the thinner portion 82. As shown in FIG. 1, the thin portion 82 close contact with the inner circumferential surface of the small-diameter portion 52; the projecting edge 83 is so disposed as to face or to be held in closely contacts the inner surface of the annular step 53; and the thick portion 81 closely contacts the inner circumferential surface of the large-diameter portion 51. When the terminal fittings 40 are inserted to a proper depth in the cavities 21, the thin portion 82 surrounds the wires 10 and is spaced from the wires 10 by a specified distance. Additionally, the inner surface of the projecting edge 83 touches the wires 10 near parts coupled to the thin portion 82, thereby bending the wires 10 inwardly (see FIG. 1).

Pairs of slits 85 are formed at three circumferentially evenly spaced-apart positions of the thinner portion 82. The respective slits 85 extend longitudinally from the rear end of the thin portion 82 and have a length that is about seven tens of the entire length of the thin portion 82. A resilient deforming piece 86 is cantilevered between each pair of slits 85, and an engaging portion 84 projects radially outward at the rear end of the resilient deforming piece 86. The engaging portion 84 is engageable with an engageable edge 59 at the rear end of the small-diameter portion 52.

The projecting edge 83 contacts the annular step 53 to prevent backward movement of the wire cover 80 while the engaging portion 84 engages the engageable edge 59 to prevent forward movement of the wire cover 80. As a result, the metal tube 50 is positioned with respect to forward and backward directions. The radial projection of the engaging portion 84 is less than the thickness of the small-diameter portion 52 so that the engaging portion 84 does not project from the outer circumferential surface of the small-diameter portion 52 while engaged with the engageable edge 59. Additionally, the rear end surface of the engaging portion 84 slopes up towards the front to prevent the shield 11 from getting caught by the engaging portion 84 when the end of the shield 11 is fit on the small-diameter portion 52.

The end of the shielded conductor path B is processed by first removing a specified length of the sheath 12 at the front end to expose the shield 11. The front end of the shield 11 then is removed by a specified length to expose the front ends of the three wires 10. The round crimping ring 55 then is mounted on the shield 11 from front and held on standby at a back position.

The thin portion 82 of the wire cover 80 then is fit into the small-diameter portion 52 of the metal tube 50 to assemble the wire cover 80 with the metal tube 50. The engaging portions 84 of the wire cover 80 contact the small-diameter portion 52 during the assembly and deform the deforming pieces 86 inwardly. Movement of the wire cover 80 stops when the projecting edge 83 of the wire cover 80 contacts the annular portion 53 of the metal tube 50. Simultaneously, the resilient deforming pieces 86 are restored to their initial postures and the engaging portions 84 engage the engageable edge 59 of the small-diameter portion 52 to retain the wire cover 80 in the metal tube 50. Thus, the wire cover 80 can be mounted into the metal tube 50 through a one-touch operation by pushing the wire cover 80.

In this state, the metal tube 50 covers the three wires 10 from the front to accommodate the wires 10 in the wire cover 80. The small-diameter portion 52 then is inserted into a clearance between the wires 10 and the shield 11, and the crimping ring 55 is slid forward over the front end of the shield 11. The crimping ring 55 then is crimped so that the front end of the shield 11 is squeezed between the small-diameter portion 52 and the crimping ring 55 to catch the shield 11 in the recess 54. In this way, the small-diameter portion 52 of the metal tube 50 is secured electrically to the front end of the shield 11. Thereafter, the metal tube 50 is retracted temporarily backward while deforming the shield 11 to contract in longitudinal direction. In this state, the terminal fittings 40 are connected with the front ends of the respective wires 10. The end processing of the shielded conductor path B is completed in this way.

The shielded conductor path B is connected with the shielded connector A by first inserting the terminal fittings 40 into the respective cavities 21. The metal tube 50 then is slid forward so that the large-diameter portion 51 of the metal tube 50 is fit into the fitting tube 25 at the rear end of the housing 20. Forward movement of the metal tube 50 stops when the front end of the large-diameter portion 51 contacts the back end surface 28 of the fitting tube 25 adjacent the rear ends of the cavities 21. The large-diameter portion 51 in the fitting tube 25 radially overlaps the inner circumferential surface of the round tube 32 of the shielding shell 30. Thus, the outer circumferential surface of the large-diameter portion 51 contacts the inner circumferential surface of the round tube 32. The resilient contact pieces 34 of the round tube 32 resiliently touch the outer circumferential surface of the large-diameter portion 51. As a result, the metal tube 50 and the shielding shell 30 are connected electrically and, thus, the shield 11 and the shielding shell 30 are connected electrically. Further, the wire cover 80 covers the wires 10 to define a space between the wires 10 and the metal tube 50.

Thereafter, a cover (not shown) fit on the shielded conductor path B in advance and held on standby at a back position is slid forward onto the fitting portion 24 (including the fitting tube portion 25) of the housing 20. Further, a rubber boot (not shown) held on standby at a back position is mounted to cover the outer circumferential surface of the cover.

As described above, the wire cover 80 is provided between the metal tube 50 and the respective wires 10 to surround the wires 10 in the shielded connector A. Thus, even if the insulation coating of the wire 10 is peeled off to expose the conductor inside, for example, due to vibration during the running of a vehicle, the conductor cannot contact the metal tube 50, thereby maintaining electrical reliability.

Further, the wire cover 80 is mounted into the metal tube 50 by the resilient engagement of the engaging portion 84 and the engageable portion 59. Thus, the wire cover 80 can be mounted into the tubular connecting member 50 through a one-touch operation.

Figure 5:
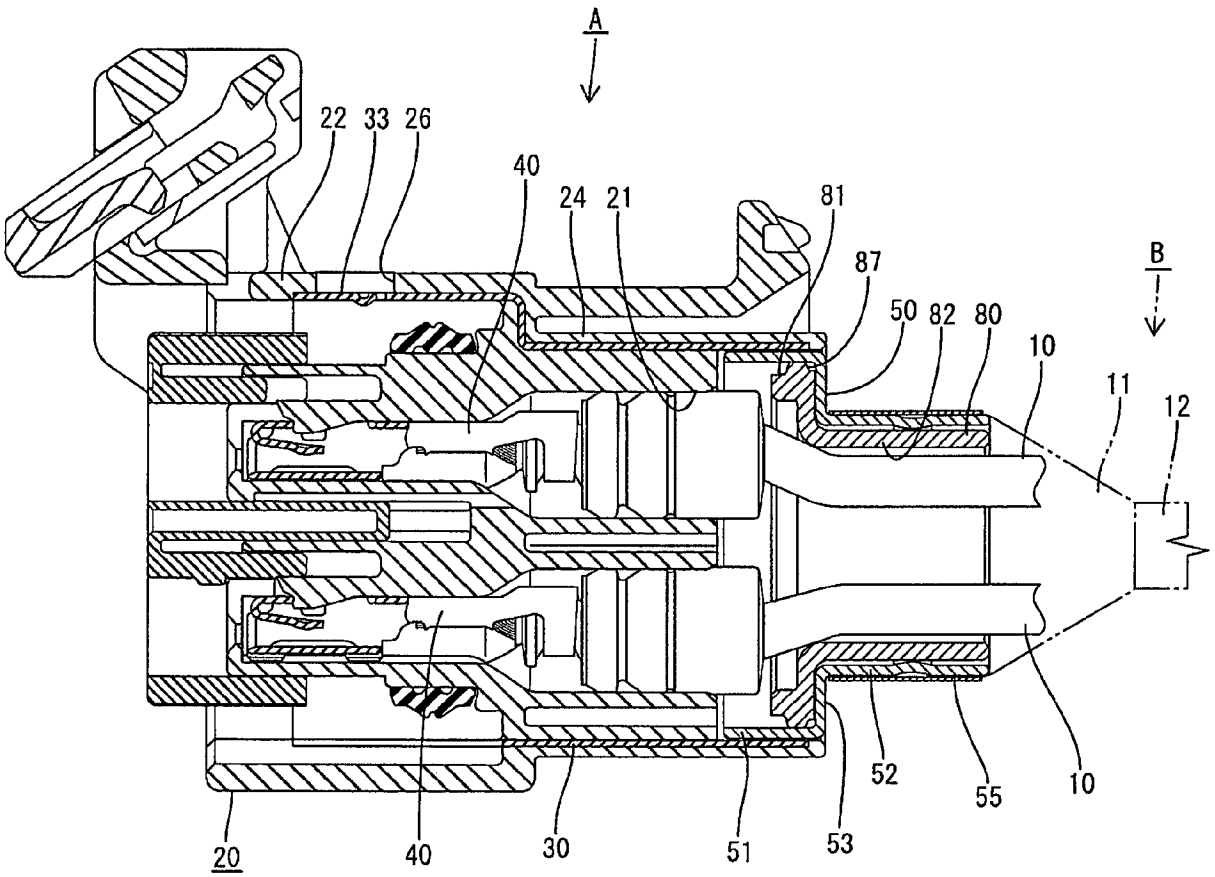
FIG. 5 is a section of a second embodiment.
Figure 6:
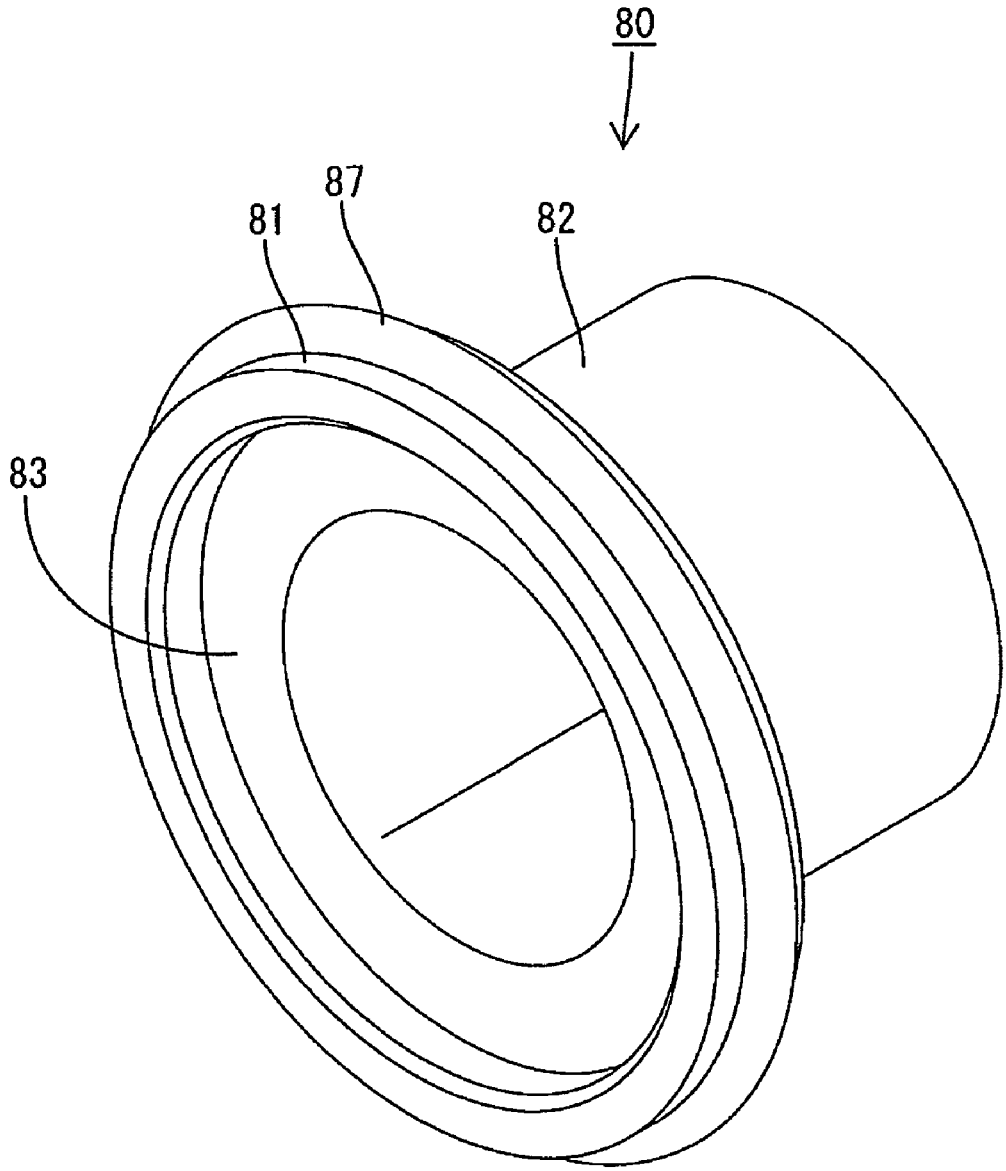
FIG. 6 is a perspective view of a wire cover.

A second embodiment of the invention is described with reference to FIGS. 5 and 6. The wire cover 80 of the second embodiment differs from the wire cover 80 of the first embodiment. However, the other construction is similar to the first embodiment. Similar members are identified by the same reference numerals, but are not described.

The wire cover 80 of the second embodiment is made of a rubber and has a thick portion 81, a thin portion 82 and a projecting edge 83, but has no resilient deforming pieces 86 and no engaging portions 84. A rib 87 stands along circumferential direction at a substantially longitudinal middle position of the thick portion 81. The outer diameter of the rib 87 is slightly larger than the inner diameter of the large-diameter portion 51 of the metal tube 50. When the wire cover 80 is assembled with the metal tube 50, the rib 87 is squeezed radially in by the inner circumferential surface of the metal tube 50. The rib 87 is pressed against the inner wall of the large-diameter portion 51 to hold the wire cover 80 in the metal tube 50.

The second embodiment has better versatility since the wire cover 80 can be mounted into various metal tubes 50 having different inner diameters within the resiliency range of the wire cover 80.

Figure 7:
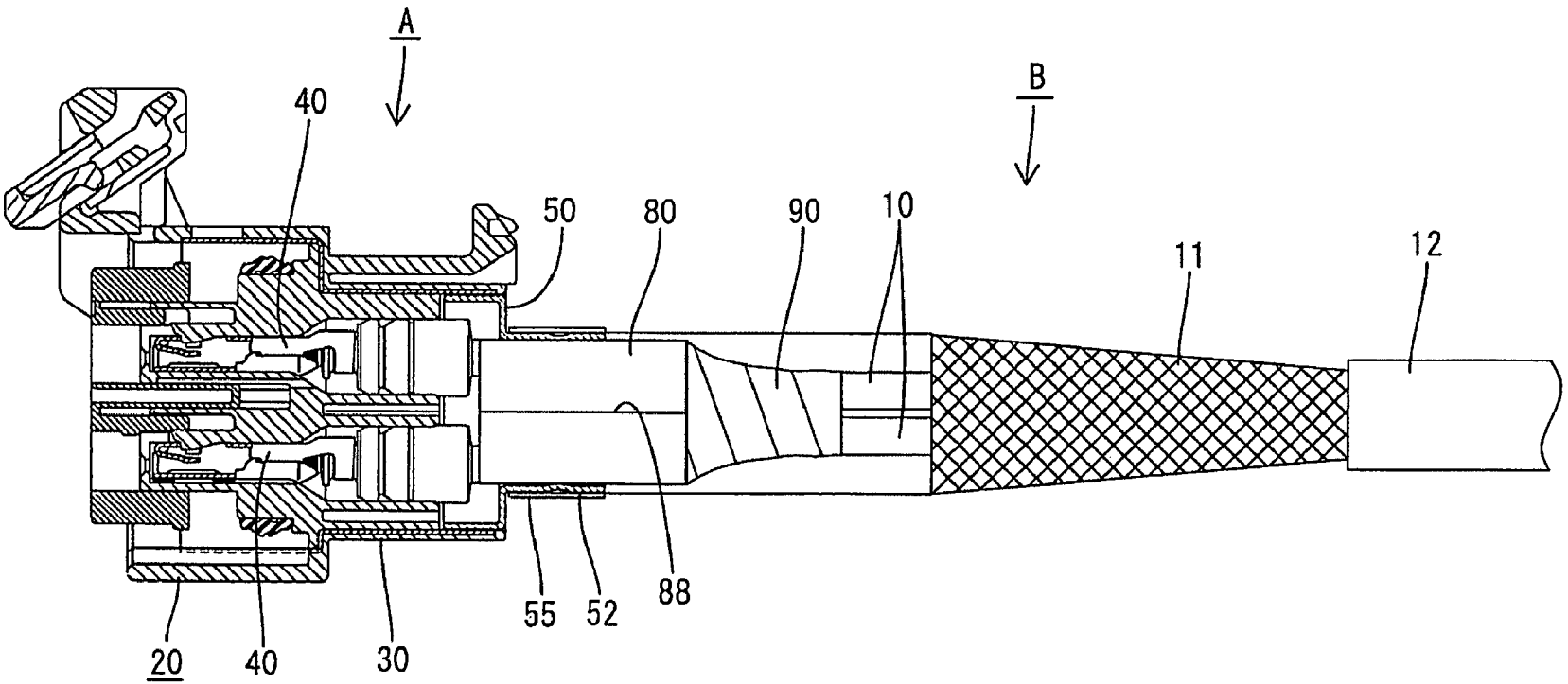
FIG. 7 is a section of a third embodiment.

A third embodiment of the invention is described with reference to FIG. 7. The shape of a wire cover 80 of the third embodiment differs from that of the wire cover 80 of the first embodiment. However, the other construction is substantially similar to the first embodiment. Similar members are identified by the same reference numerals, but are not described.

The wire cover 80 of the third embodiment is a round tube made of an insulating synthetic resin and has a substantially uniform diameter over the entire length along forward and backward directions. The wire cover 80 has a longitudinal slit 88 so that that the wire cover 80 can deform to a smaller diameter when fit into the small-diameter portion 52 of the metal tube 50. An insulating tape 90 is wound around the wires 10 from the rear end of the wire cover 80 to fix the wire cover 80 to the wires 10. The tape 90 prevents displacement of the wire cover 80 relative to the wires 10.

Figure 8:
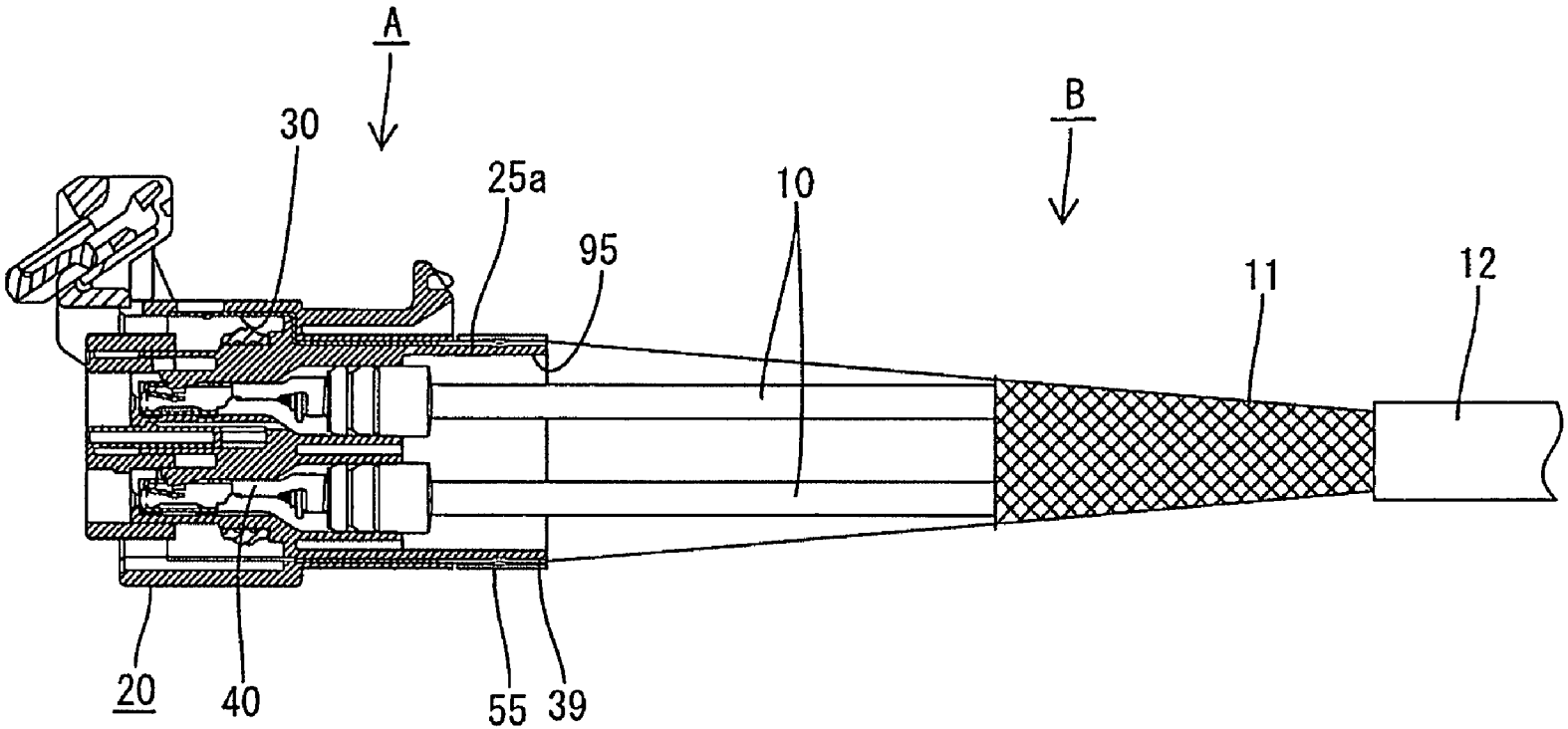
FIG. 8 is a section of a fourth embodiment.

A fourth embodiment of the invention is described with reference to FIG. 8. The fourth embodiment does not include a part corresponding to the metal tube 50 and the wire cover 80. Rather, a part of the inner wall of the housing 20 functions as the wire cover 80.

Specifically, the housing 20 of the fourth embodiment has a fitting tube 25*a* with an insulating wall 95 that extends along the inner circumferential surface of the rear half of the shielding shell 30, and extends more backward than the fitting tube 25 of the first embodiment. The insulating wall 95 covers the wires 10 and defines a specified space between the wires 10 and the shielding shell 30.

The outer surface of the rear half of the shielding shell 30 is exposed to receive the end of the shield 11 and to define a metal tube 39.

The insulation coating of the wire 10 could be peeled off to expose the conductor inside. However, the insulating wall 95 prevents contact of such a conductor with the metal tube 39. Since the metal tube 50 and the wire cover 80 as separate members are not necessary in this case, there is a merit of reducing the number of parts.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The shielding shell and the housing are formed integrally by insert molding in the foregoing embodiments. However, the shielding shell may be assembled with the already molded housing according to the invention.

A lever-type connector is described in the foregoing embodiments. However, the invention is also applicable to connectors with no lever.

The insulating wall is between the metal tube and the wires in the fourth embodiment. However, a member corresponding to the wire cover made of a synthetic resin described in the first or third embodiment may be fit into the metal tube or a member corresponding to the wire cover made of a rubber described in the second embodiment may be mounted on the inner circumferential surface of the metal tube according to the invention.

What is claimed is:

1. A shielded connector connectable with a shielded conductor path having at least one wire surrounded by a tubular shield, comprising:

a housing for accommodating at least one terminal fitting connected with an end of the wire;

a conductive shielding shell engaged with the housing;

a conductive tube connecting the shielding shell and the shield and surrounding the wire; and an insulation disposed between the conductive tube and the wire to define a specified space therebetween.

2. The shielded connector of claim 1, wherein the insulation is a wire cover made of a synthetic resin and fittable into the conductive tube.

3. The shielded connector of claim 2, wherein the wire cover includes an engaging portion resiliently engageable with an engageable portion on the conductive tube and is mounted in the conductive tube by resiliently engaging the engaging portion and the engageable portion.

4. The shielded connector of claim 2, wherein the wire cover is fixed to the wire by winding an insulating tape.

5. The shielded connector of claim 1, wherein the wire cover is fixed to the wire by winding an insulating tape.

6. The shielded connector of claim 1, wherein the insulation is a wire cover made of a rubber and fitted to an inner circumferential surface of the conductive tube.

7. A shielded connector connectable with a shielded conductor path having at least one wire surrounded by a tubular shield, comprising:

a housing for accommodating at least one terminal fitting connected with an end of the wire; and a conductive shielding shell arranged for shielding the housing, the shielding shell including a tubular connecting portion directly connectable with an end of the tubular shield; and an insulation disposed between the tubular connecting portion and the wire to define a space therebetween.

8. The shielded connector of claim 7, wherein the insulation comprises an insulating wall integrally extended from the housing.

9. The shielded connector of claim 7, wherein the insulation is a wire cover made of a synthetic resin and fittable into the tubular connecting portion.

10. The shielded connector of claim 7, wherein the insulation is a wire cover made of a rubber and fitted to an inner circumferential surface of the tubular connecting portion.

11. A shielded connector connectable with a shielded conductor path having wires surrounded by a tubular shield, comprising:

a housing with cavities for accommodating terminal fittings connected with ends of the wires;

a conductive shielding shell engaged with the housing and substantially surrounding the terminal fittings;

a conductive tube connecting the shielding shell and the shield and surrounding portions of the wires between shielding shell and the shield of the conductor path;

a substantially tubular wire cover formed from an insulating resin and disposed between the conductive tube and the wires to maintain a specified space therebetween; and an insulating tape wrapped around the wires and the wire cover for securing the wire cover in fixed position relative to the wires.

12. The shielded connector of claim 11, wherein the wire cover is formed from a resiliently deformable resin and is split longitudinally, the wire cover being deformed inwardly for insertion into the conductive tube and exerting resilient outward restoring forces against the conductive tube for positioning the wire cover relative to the conductive tube.

* * * * *